US005943718A

United States Patent [19]

Krauter

[11] Patent Number: 5,943,718

[45] Date of Patent: Aug. 31, 1999

[54] LEG FITTING FOR A WALL FOLDING BED

[75] Inventor: Jochen Krauter, Nagold, Germany

[73] Assignee: Hafele GmbH & Co., Nagold, Germany

[21] Appl. No.: 09/104,322

[22] Filed: Jun. 25, 1998

[30] Foreign Application Priority Data

Jun. 30, 1997 [DE] Germany ..... 297 11 365

[51] Int. Cl.[6] ..... A47C 31/00

[52] U.S. Cl. ..... 5/658; 5/312; 5/315.1; 74/527

[58] Field of Search ..... 5/658, 659, 661, 5/507.1, 310, 311, 312, 313.1, 314.1, 315.1; 403/323, 321; 297/14; 298/188; 108/131, 132; 74/527; 292/145, 67, 63, 109, 114

[56] References Cited

U.S. PATENT DOCUMENTS 268,326 11/1882 Warner et al. ..... 5/312 X 5,114,193 5/1992 Nass ..... 292/67

5,845,535 12/1998 Wakabayashi ..... 74/527 X

FOREIGN PATENT DOCUMENTS 903728 8/1962 United Kingdom ..... 292/67

*Primary Examiner*—Brian K. Green
*Assistant Examiner*—Rodrigo J. Morales
*Attorney, Agent, or Firm*—Friedrich Kueffner

[57] ABSTRACT

A leg fitting, preferably for a wall folding bed, includes an angle-shaped member with first and second arms, wherein the first arm is mounted in a support member such that the angle-shaped member can be pulled out and turned, and wherein the second free arm forms a standing leg when the angle-shaped member has been pulled out and turned. The leg fitting is provided with a forced guide device at least for the pulling out movement of the angle-shaped member. The forced guide device ensures that the angle-shaped member can only be turned into its standing leg position once the free arm of the angle-shaped member can be turned into this position without damaging other components.

6 Claims, 1 Drawing Sheet

LEG FITTING FOR A WALL FOLDING BED

BACKGROUND OF THE INVENTION

1. Field of the Invention

The present invention relates to a leg fitting, preferably for a wall folding bed. The leg fitting includes an angle-shaped member with first and second arms, wherein the first arm is mounted in a support member such that the angle-shaped member can be pulled out and turned, and wherein the second free arm forms a standing leg when the angle-shaped member has been pulled out and turned.

2. Description of the Related Art

In wall folding beds, a leg fitting is usually attached to the inner side of the front plate of the bed frame, so that the leg fitting is covered by the front plate when the bed is folded up. Only once the bed is folded down, a leg is formed on the bed by pulling a standing leg of the leg fitting manually from an initial position into a standing leg position.

In a known leg fitting of the above-described type, the standing leg is formed by a free arm of a right angle-shaped member, wherein the free arm can be pulled beyond the front edge of the front plate and can then be turned by 90° into the standing leg position. The support member is a rectangular pipe piece, wherein the other arm of the angle-shaped member having a round outer cross-section is mounted in the rectangular pipe piece so as to be capable of being pulled out of and rotated in the pipe piece. As long as the free arm of the angle-shaped member forming the standing leg is not pulled beyond the front edge of the front plate, the front plate prevents the angle-shaped member from being turned. Since the angle-shaped member is freely rotatably mounted in the support member, the free arm of the angle-shaped member can slide along the front plate or the bed frame when the free arm is pulled out and the angle-shaped member is turned and, thus, the free arm can damage these components.

SUMMARY OF THE INVENTION

Therefore, it is the primary object of the present invention to prevent damage in a leg fitting of the above-described type when the angle-shaped member is moved into its standing leg position.

In accordance with the present invention, the above object is met by providing a forced guide means at least for the pulling out movement of the angle-shaped member.

The forced guide means provided in accordance with the present invention ensures that the angle-shaped member can only be turned into its standing leg position once the free arm of the angle-shaped member can be turned into this position without damaging other components. In addition to the pulling-out movement, the turning movement of the angle-shaped member is preferably also subjected to a forced guide means. Consequently, in a wall folding bed, turning of the angle-shaped member into its standing leg position is only possible after the angle-shaped member has been pulled beyond the front edge of the front plate. Up to that point, the free arm of the angle-shaped member is held at a distance from the front plate.

In order to be able to secure the angle-shaped member in its standing leg position, a particularly preferred embodiment of the present invention provides that the angle-shaped member is lockable in its pulled-out and turned position.

In accordance with another preferred embodiment, the forced guide means according to the present invention is composed of a guide recess in the support member and a guide pin of the angle-shaped member guided in the guide recess.

In accordance with a particularly advantageous further development of this embodiment of the invention, the guide recess has a first guide portion extending in the pulling-out direction. This first guide portion preferably extends parallel to the axis of rotation of the angle-shaped member, so that the pulling-out movement and the turning movement of the angle-shaped member are uncoupled from each other with respect to time. However, it is also possible to provide a guide recess in which the angle-shaped member is simultaneously pulled out and turned.

In accordance with an advantageous feature of this further development, connected in the pulling-out direction to the first guide portion is a second guide portion which extends obliquely, preferably transversely of the pulling-out direction, wherein the angle-shaped member is guided in the second guide portion so as to be rotatable preferably by 90°.

In accordance with a particularly advantageous further development, the guide recess has a third guide portion which is connected to the first or second guide portion and extends against the pulling-out direction. The pulled-out and turned angle-shaped member can be pushed back slightly in the third guide portion against the pulling-out direction. By pushing the angle-shaped member back in this manner, the angle-shaped member turned into its standing leg position can be locked against rotation and against the pulling-out direction. If such a third guide portion is provided, the second guide portion does not have to act as a forced guide means for the angle-shaped member, but only has to facilitate the turning of the angle-shaped member.

Preferably, one arm of the angle-shaped member is supported in two oppositely located side walls of the support member, preferably through appropriate bearing bushings.

In accordance with an especially preferred embodiment of the invention, the guide recess is formed in a wall of the support member which at least partially extends over the one arm of the angle-shaped member. This embodiment has the advantage that no additional parts are required for forming the guide recess.

The cross-section of the wall and the arm of the angle-shaped member guided on the wall are adapted to each other in such a way that a guidance of the angle-shaped member, for example, by means of the guide pin, is ensured within the guide recess in the pulling-out direction as well as in the turning direction. In order to be able to manufacture the wall engaging over the arm of the angle-shaped member in as simple a manner as possible by edging or bending, the wall of the support member engages over the arm in the shape of a roof. However, other shapes of the wall which engage over the arm of the angle-shaped member and which can be manufactured by edging or bending, for example, polygonal or round wall cross-sections, are possible according to the present invention.

In accordance with a particularly preferred embodiment of the invention, the support member is formed of a flat sheet metal blank, preferably by edging. The flat sheet blank, which may be manufactured by punching and/or nippling, can be further processed by subsequent edging or bending in a simple and inexpensive manner into a support member for the angle-shaped member.

In order to even further simplify the manufacture, the flat sheet metal blank is constructed so as to be symmetrical, with the exception of the guide recess and side pieces of the blank, relative to the longitudinal center line of the blank.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
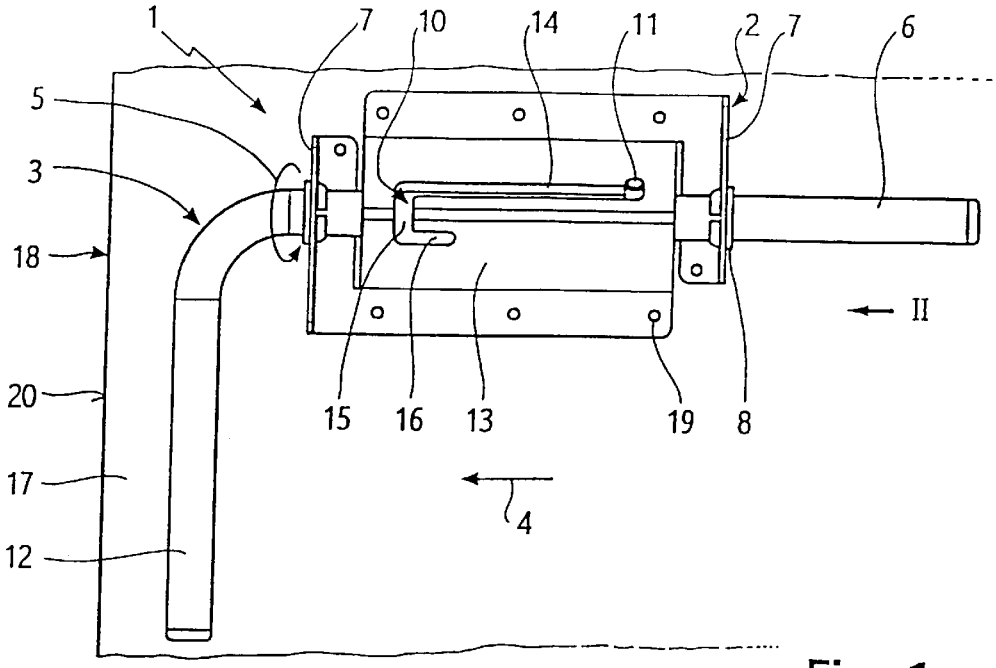
FIG. 1 is a top view of a leg fitting according to the present invention, shown in the initial position.
Figure 2:
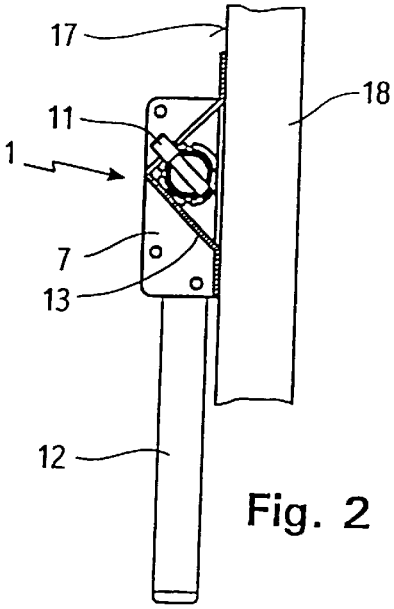
FIG. 2 is a side view of the leg fitting in the direction of arrow II of FIG. 1.

The leg fitting 1 shown in FIGS. 1 and 2 in its initial position includes a support member 2 and a right angle-shaped member 3 supported in the support member 2. The angle-shaped member 3 can be moved in a forcibly guided manner from the initial position in the pulling-out direction 4 and the turning direction 5 into a standing leg position, not shown.

Figure 3:
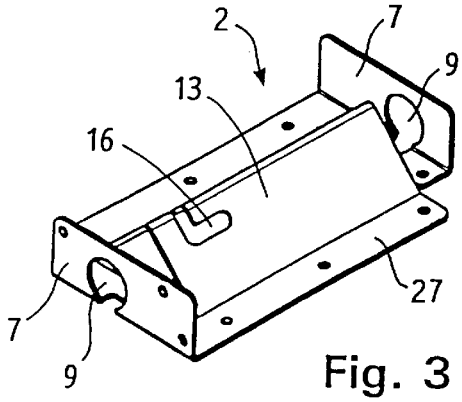
FIG. 3 is a perspective view of a support member of a leg fitting of FIG. 1.

For this purpose, the first arm 6 of the angle-shaped member 3 is mounted so as to be movable in the pulling-out direction 4 and the turning direction 5 in two oppositely located side walls 7 of the support member by means of two bearing bushings 8 which are each placed in a bearing bore 9, shown in FIG. 3, in the two side walls 7. The movement of the angle-shaped member 3 is predetermined by a slot-shaped guide recess 10 provided in the support member 2. The angle-shaped member 3 is guided in a forced manner in the guide recess 10 by means of a guide pin 11. As shall be explained in more detail below, the second free arm 12 of the angle-shaped member 3 forms the standing leg of the leg fitting 1 once the angle-shaped member 3 has been moved into the standing leg position.

The guide recess 10 is formed in a wall 13 of the support member 2 which extends in the manner of a roof over the arm 6. In other words, the wall 13 is composed of two portions which extend at an angle relative to each other. The guide recess 10 has three guide portions 14, 15, 16. The first guide portion 14 extends in the pulling-out direction 4 and then continues in the second guide portion 15 which extends in the turning direction 5 or transversely of the pulling-out direction 4, and the second guide portion 15, in turn, is followed by a third guide portion 16 extending against the pulling-out direction 4. While the first guide portion 14 extends almost over the entire length of the wall 13, the third guide portion 16 only has a short length as compared to the guide portion 14.

The leg fitting 1 is mounted on the inner side 17 of a front plate 18 of a bed through fastening holes 19. In the initial position of the angle-shaped member 3, the arm 12 extends parallel to and at a distance from the inner side 17. For forming a standing leg, the angle-shaped member 3 is pulled from its initial position shown in FIG. 1 in the pulling-out direction 4 corresponding to the first guide portion 14, wherein, at the end of this pulling-out movement, the arm 12 protrudes beyond the front edge 20 of the front plate 18. The angle-shaped member 3 is then turned in accordance with the second guide portion 15 in the turning direction 5 by 90° into the standing leg position in which the arm 12 which now engages at a right angle around the front plate 18 forms the standing leg of the leg fitting 1. By subsequently pushing back the turned angle-shaped member 3 by a short distance against the pulling-out direction 4 in the third guide portion 16, the angle-shaped member 3 or its arm 12 is locked in the standing leg position against rotation and against the pulling-out direction 4. By moving the angle-shaped member 3 in the reverse sequence, the angle-shaped member 3 is returned once again from its standing leg position into its initial position.

Figure 4:
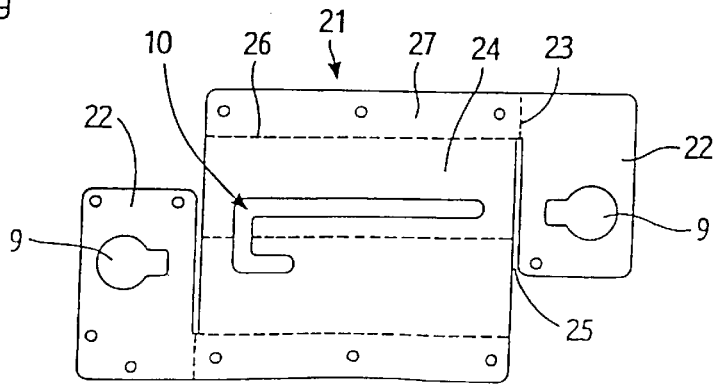
FIG. 4 is a top view of a sheet metal blank used for manufacturing the support member of FIG. 3.

The support member 2 shown separately in FIG. 3 is manufactured by edging the flat sheet metal blank 21 shown in FIG. 4. For this purpose; the two side portions 22 of the sheet metal blank 21 are bent upwardly about the edge lines 23 to form the side walls 7 and the middle portion 24 of the sheet metal blank 21, which is separated from the side portions 22 by a recess 25, is bent upwardly about the three parallel edge lines 26 to form the roof-shaped wall 13 which extends over the arm 6. Two longitudinal strips 27 remaining within the plane of the sheet metal blank 21 form the contact surface of the support member 2. With the exception of the guide recess 10 and the side pieces 22, the sheet metal blank 21 is symmetrical relative to its longitudinal center line.

While specific embodiments of the invention have been shown and described in detail to illustrate the inventive principles, it will be understood that the invention may be embodied otherwise without departing from such principles.

I claim:

1. A leg fitting for a wall folding bed, the leg fitting comprising an angle-shaped member having first and second arms perpendicular to each other, a support member in which the first arm is mounted so as to be capable of being pulled out and rotatable, said support member comprising two oppositely located side walls, the first arm of the angle-shaped member being mounted through the side walls, wherein the second arm forms a standing leg when the angle-shaped member is pulled out and turned, further comprising a forced guide means for a pulling-out movement of the angle-shaped member, wherein the forced guide means is comprised of a guide recess in the support member and a guide pin on the angle-shaped member guided in the guide recess, wherein the guide recess comprises a first guide portion extending in a pulling-out direction, a second guide portion connected to the first guide portion and extending perpendicularly relative to the pulling-out direction, and a third guide portion connected to one of the first and second guide portions and extending against the pulling-out direction.

2. The leg fitting according to claim 1, wherein the support member comprises a third wall at least partially extending over the first arm of the angle-shaped member, and wherein the guide recess is formed in the third-wall of the support member.

3. The leg fitting according to claim 2, wherein the third wall of the support member extending over the first arm comprises two wall portions extending at an angle relative to each other.

4. The leg fitting according to claim 1, wherein the support member is made of a flat sheet metal blank.

5. The leg fitting according to claim 4, wherein the sheet metal blank is formed by bending.

6. The leg fitting according to claim 4, wherein the sheet metal blank has side pieces, and wherein, with the exception of the guide recess and the side pieces, the sheet metal blank is symmetrical relative to a longitudinal center line thereof.

* * * * *